United States Patent [19]

Tibbals

[11] 4,234,204

[45] Nov. 18, 1980

[54] SKATEBOARD

[76] Inventor: Kerry W. Tibbals, 2720 Rosalyn Ct., New Hope, Minn. 55427

[21] Appl. No.: 968,129

[22] Filed: Dec. 11, 1978

[51] Int. Cl.[3] ..... A63C 17/14

[52] U.S. Cl. ..... 280/87.04 A; 280/11.2

[58] Field of Search ..... 280/87.04 R, 87.04 A, 280/87.04 B, 11.2, 11.19

[56] References Cited

U.S. PATENT DOCUMENTS

| | | | |
|---|---|---|---|
| 4,037,852 | 7/1977 | Bayer et al. | 280/87.04 A |
| 4,084,831 | 4/1978 | Akonteh et al. | 280/87.04 A X |
| 4,094,524 | 6/1978 | Carroll | 280/87.04 A X |

*Primary Examiner*—John J. Love
*Assistant Examiner*—Michael Mar
*Attorney, Agent, or Firm*—Merchant, Gould, Smith, Edell, Welter & Schmidt

[57] ABSTRACT

An improved skateboard comprises a board member pivotally mounted on a frame. One wheel support unit is carried on the frame and the other wheel support unit is carried on the board member for movement relative to the frame. The movably mounted wheel support unit will have the wheels thereof brought into engagement with the frame when the board member is pivoted relative to the frame to effect a braking action on the wheels.

12 Claims, 3 Drawing Figures

FIG. 1
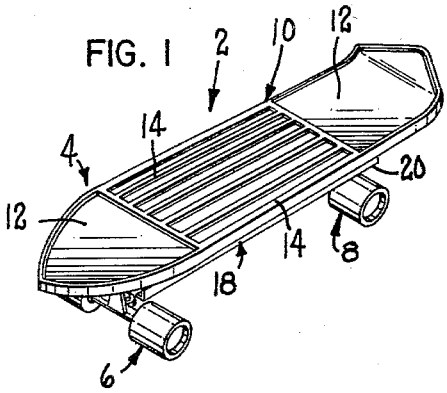
FIG. 2
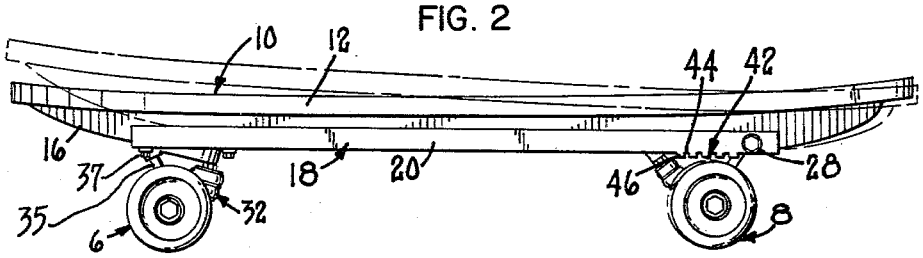
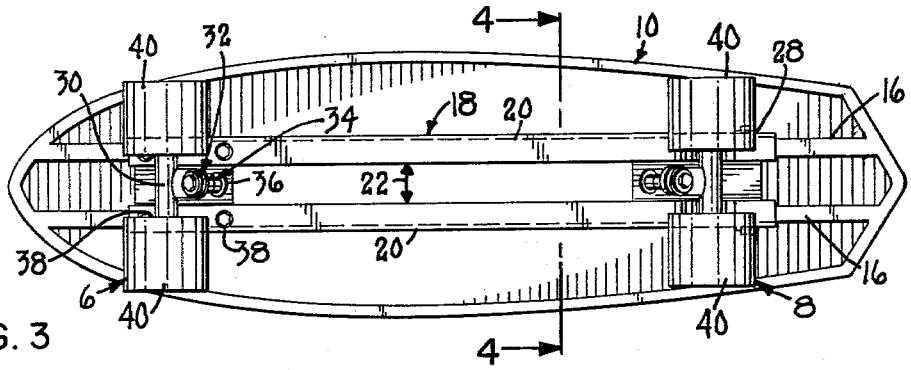
FIG. 3
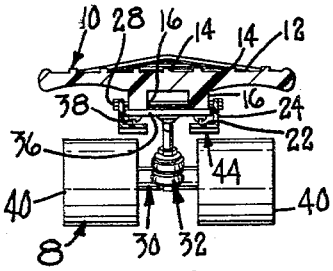
FIG. 4

SKATEBOARD

TECHNICAL FIELD

This invention relates generally to recreational skating devices of the type commonly known skateboards.

DESCRIPTION OF THE PRIOR ART

Skateboards are recreational devices which have become extremely popular in recent years. Although skateboards may vary in size, color, or configuration, they are nonetheless similarly constructed. Skateboards generally comprise a relatively rigid board member which is rollably supported by two sets of rotatable support wheels located adjacent the front and back ends of the board. The manner of use of skateboards is also similar. A rider stands in a generally upright position on top of the board and balances thereon as the skateboard rolls down an incline. More advanced riders can often perform various tricks on the board, such as performing handstands on the board or causing the skateboard to revolve in tight circles.

One problem associated with the use of skateboards is that of slowing the board down after it has attained a high rate of speed. This is especially important for riders who may not have had a great deal of experience since the standard method of dismounting the board has usually been simply jumping off the board and letting the board continue downhill until it runs into an abutment causing it to stop. Such a procedure is disadvantageous for a number of reasons. First, the rider encounters some degree of risk of injury in merely jumping off the board due to the chance of turning or breaking an ankle or injuring another part of the body if the rider should fall. In addition, because the board is let go in an uncontrolled manner after the rider jumps off the board, the board because of its momentum poses a risk of injury to any bystanders.

Another area in which it is desirable to have a precise means for controlling the speed of the skateboard is that which involves tricks or acrobatics on the board. One particular trick which is popular is to have the rider cause the board to flip around in half or full circles during progress down a hill. With currently constructed skateboards, the board has a tendency to slide out from under the rider during the performance of such maneuvers. Only riders with a high degree of skill are usually able to perform such maneuvers safely and prevent the board from sliding out from under them. If less skilled riders attempt these maneuvers, they often fall by virtue of their inability to properly control the board. Such falls may result in injury.

Thus, there is demonstrated need for means for accurately slowing or stopping the skateboard either to dismount the board or as means for properly controlling the board during trick acrobatics. A number of prior art skateboards have utilized various brakes of one type or another. One such brake is a block which is fixed to the underside of the skateboard near the rear edge. If the rider then tilts the skateboard up with the front end of the board leaving the ground, the block will then be brought into engagement with the ground and serve to brake the forward momentum of the board. Another type of skateboard brake which has been proposed is a pedal actuated type brake in which a pedal extends through the top surface of the board near the rear thereof. When the rider pushes down on the pedal with one of his feet, a brake block underneath the board is brought into engagement with the rear wheels to effect slowing of the board.

While these brakes are generally effective for the purpose for which they are designed, they have a number of disadvantages. For example, the fixed block type brake is subject to severe abrading because of its contact with the ground which often comprises a paved surface. Thus, the fixed block encounters a great deal of wear and may have to be replaced from time-to-time. In addition, the pedal type brake is relatively complex requiring a linkage between the pedal and the break mechanism itself. Furthermore, the pedal must extend above the surface of the board detracting from the aesthetic appearance of an otherwise unbroken board surface. Moreover, the pedal may be difficult to actuate by a rider who is not skilled.

SUMMARY OF THE INVENTION

One aspect of this invention is the provision of an improved skateboard having a braking means for slowing or breaking the skateboard which braking means is particularly simple, inexpensive and effective.

An improved skateboard according to this invention comprises a multi-part board unit. The board unit includes an elongated board member, a frame, and means for pivotably mounting at least a portion of the board member relative to the frame. The board unit is rollably supported on a ground surface by two wheel support units each of which has one or more wheels therein. One wheel support unit is carried on the pivotal portion of the board member. When the rider is normally operating the skateboard, the one wheel support unit is spaced away from the frame. However, when the rider steps on the pivotal board portion to cause that board portion to rotate relative to the frame, the wheels of the one wheel support unit are drawn up into engagement with the frame to cause a braking of these wheels and slowing of the skateboard.

BRIEF DESCRIPTION OF THE DRAWINGS

The present invention will be described hereafter in conjunction with the following drawings, wherein like reference numerals will refer to like elements throughout.

FIG. 1 is a perspective view of an improved skateboard according to this invention;

FIG. 2 is a side elevational view of the skateboard of FIG. 1, showing the board member in a normal operating position in solid lines and in a second position in phantom lines at which the board member is rotated relative to the frame and the rear support wheels are being braked;

FIG. 3 is a bottom plan view of the skateboard of FIG. 1; and

FIG. 4 is a cross-sectional view of the skateboard of FIG. 1 taken along lines 4—4 in FIG. 3.

DETAILED DESCRIPTION OF THE INVENTION

Referring first to FIG. 1, an improved skateboard according to this invention is generally illustrated as 2. Skateboard 2 includes a multi-part board unit 4. Board unit 4 is rollably supported for movement over a ground surface by first and second sets of wheel support units 6 and 8. Wheel support units 6 and 8 are located respectively adjacent each end of the board unit 4.

Board unit 4 comprises two major interrelated parts. The first part is an elongated substantially rigid board member 10. Board member 10 has a substantially horizontal support surface 12 on which the rider of skateboard 2 stands. Support surface 12 may include a plurality of longitudinally elongated ribs 14 which form a traction surface having enhanced frictional resistance with regard to the feet of the rider. In addition, a plurality of longitudinally extending ribs 16 may be attached to the underside of the support surface 12 and extend downwardly therefrom. As shown in FIG. 4, two such ribs 16 are provided for a purpose to be described in more detail hereafter. However, more or less ribs 16 could be provided if desired.

Board member 10 may have any suitable color, configuration, or shape. Preferably, the front and back ends of the board member 10 are slightly tilted or slanted upwardly as indicated in FIG. 2. Board member 10 may be made of any suitable materials and is preferably integrally molded out of high density rigid polypropylene plastic. However, other suitable materials and methods of manufacturing board member 10 may be used. Board member 10 need not necessarily be a single unitary piece as shown in the drawings, but could be formed from a number of composite pieces joined together.

Board unit 4 also includes an elongated substantially rigid frame which is generally indicated as 18. Frame 18 includes two elongated frame members 20 transversely spaced apart by a suitable distance 22. Frame members 20 are preferably L-shaped, each having a bottom wall 24 and an upwardly extending side wall 26. Frame members 20 are integrally connected together to form frame 18 by means of the front wheel support unit 6. In addition, cross pieces (not shown) may be used to span the transverse distance 22 and integrally connect the opposed frame members 20 together. Preferably, frame 18 is integrally formed of polypropylene plastic or other suitably rigid materials.

The two separate components of board unit 4, i.e. board member 10 and frame 18, are operatively interrelated together by means of a substantially horizontal transverse pivot pin generally indicated as 28. Pivot pin 28 passes through the rear end of frame 18 and through any suitable bore or other pivot support structure formed on the underside of board member 10. For example, pivot pin 28 could pass through suitable pivot pin receiving openings contained in the downwardly depending ribs 16. Or, alternatively, the underside of board member 10 could be provided with other suitable downwardly depending structure for pivotally receiving the pivot pin 28.

By virtue of pivot pin 28, board member 10 is pivotally mounted in relation to frame 18. As shown in solid lines in FIG. 2, the board member 10 has a first position relative to frame 18 corresponding to normal operation of the skateboard. In such a position, board member 10 is substantially parallel with the frame 18 and has the downwardly depending ribs 16 located between the side walls 26 of frame members 20. However, as will be described in more detail hereafter, the board member 12 can be tilted upwardly about the pivot pin 28 to a second position shown in phantom lines in FIG. 2. In this position, that portion of the board member 10 which is forward of pivot pin 28 has been raised relative to the frame 18. Only clockwise rotation of the board member 10 is allowed from the normal position of the board member. Any attempted counterclockwise rotation from the solid line position shown in FIG. 2 is prevented by the engagement of the ribs 16 or rear wheel support unit 8 with the horizontal bottom walls 24 of frame members 20.

As shown in FIGS. 2 and 3, each of the wheel support units 6 and 8 are generally similar. Each support unit includes a transverse axle housing 30 which contains an axle (not shown) for rotatably mounting a set of support wheels 40. Axle housing 30 is coupled by a resilient mounting means 32 to an upwardly extending spindle 34. The spindle 34 is attached at its upper end to a mounting plate 36. Mounting plate 36 may be attached to any suitable securing means, such as bolts or screws 38, to any desired portion of board unit 4. In addition, axle housing 30 has a second upwarding extending spindle 35 whose upper end is formed as a ball to coact with a socket 37 on mounting plate 36 to constitute a ball and socket pivot joint. Board unit 4 can be tilted from side to side about a longitudinal axis through the length of the board unit by virtue of the resilient mounting means 32 and the ball and socket pivot joint between spindle 35 and plate 36. Both of the axle housings 30 rotatably mount two opposed rotatable support wheels 40. Support wheels 40 are preferably the conventional urethane type wheels which are customarily used on skateboards. Any conventional type of wheel support units 6 and 8 can be used in place of the units shown if so desired.

As shown particularly in FIGS. 3 and 4, the front wheel support unit 6 is rigidly attached to the front frame 18. However, the rear wheel support unit 8 is carried by the rear portion of board member 10 in front of pivot pin 28. In this regard, the mounting plate 36 for the rear wheel support unit 8 is fixedly coupled by screws 38 to the downwardly depending ribs 16. See FIG. 4. Such an arrangement of the wheel support units 6 and 8 on frame 18 and board member 10 constitutes an important part of an improved brake for the skateboard 2.

Referring now to FIG. 2, the operation of the skateboard 2 according to this invention will be explained. In normally using the skateboard 2, a rider stands on the board member 10 with the board member being in its fisrt solid line position. However, whenever it is desired to brake the skateboard, either for simply slowing the skateboard down or for performing various types of tricks, the rider need only step on the rear end of board member 10 to tilt board member 10 about the pivot pin 28 to its phantom line position. Because the rear wheel support unit 8 is fixedly attached to the board member 10, the distance between that support unit and the frame is decreased until the wheels 40 of the rear support unit 8 contact the underside of the frame 18 at a position generally indicated as 42. Thus, a frictional restraining force is exerted between the frame 18 and the rear support wheels 40 to slow the wheels down. If desired, the underside of the frame 18 may include means for increasing the frictional resistance between the frame and the wheels. Such means preferably include integrally molded brake shoes 44 on the bottom of frame 18. Brake shoes 44 comprise a plurality of transversely oriented ribs 46.

Thus, the present invention relates to an extremely simple but effective means for braking skateboard 2. All that is required for braking the board is that the rider put his weight near the rear end of board member 10 to allow board member 10 to assume its dotted line position. This causes the wheels 40 of the rear wheel support unit 8 to engage the brake shoes 44 and slow the wheels down. No complex actuating mechanism such as used in pedal type brakes is required. In addition, because the ribs 16 are normally contained inside the sidewalls 26 of the frame members 20, this construction constitutes a means for laterally confining or centering the board member 10 in the frame 18 when the board member 10 is in its normal solid line position. Thus, even though the board member 10 is pivotally mounted relative to frame 18, in the normal operating position of the board member 10 the board member is centered in the frame 18 and confined thereto allowing the board member 10 to operate in a normal manner.

In addition, the skateboard 2 of this invention also allows braking of the rear support wheels 40 simply by tilting the board member from one side to the other about a longitudinal axis through the board member. This is done by having the rider shift his weight from one side of the board member to the other. When this occurs, one or the other of the rear support wheels 40 is brought into engagement with the adjacent brake shoe 44. In this type of braking operation, it is not strictly necessary for the board to be pivotably mounted relative to the frame 18. However, this mode of the braking operation is not preferred since it results in braking of only one of the rear wheels 40, thereby yielding an uneven braking force on the skateboard. When the board member is pivotted upwardly as in the preferred embodiment described earlier, both rear wheels 40 are braked evenly.

Various modifications of this invention are apparent. For example, the entire length of the board member 10 need not be pivotally mounted relative to frame 18. For example, the board member 10 could have the front half fixed to frame 18 with the rear half being pivotally mounted by virtue of pivot pin 28. However, such a construction would act in a generally identical manner to the primary embodiment noted above. In addition, the location of pivot pin 28 can obviously vary. Furthermore, the brake shoes 44 need not be integrally formed with the frame 18 as is preferred or brake shoes need not even necessarily be provided on frame 18. Thus, brake shoes 44 could be separate brake shoes replaceably attached to the bottom of frame 18 by screws, or the wheels 40 could simply engage the bottom of a smooth frame 18 and still be slowed thereby. Thus, the scope of this invention is to be limited only by the appended claims.

I claim:

1. An improved skateboard, which comprises:

(a) a multi-part board unit, which includes:
  (i) an elongated board member suited for supporting a rider thereon;
  (ii) a frame;
  (iii) means for pivotably mounting at least a portion of the board member relative to the frame for rotation about a substantially horizontal pivot axis;

(b) at least one wheel support unit carried adjacent and attached to each end of the board unit for rollably supporting the board unit on a ground surface, wherein each wheel support unit has one or more ground engaging wheels; and (c) wherein one wheel support unit is carried on the pivotal portion of the board member with the wheel or wheels thereof being spaced from the frame when the pivotal portion is in a first position, whereby rotation by the rider of the pivotal portion to a second position causes the wheel or wheels of the one wheel support unit to engage the frame to effect a braking action thereon.

2. An improved skateboard as recited in claim 1, wherein the frame includes means for increasing frictional resistance between the frame and the wheel or wheels of the one wheel support unit.

3. An improved skateboard as recited in claim 2, wherein the frictional resistance increasing means comprises a roughened surface on the frame which surface is suited for contacting the wheel or wheels of the one wheel support unit.

4. An improved skateboard as recited in claim 1, wherein the entire board member is pivotably mounted relative to the frame.

5. An improved skateboard as recited in claim 4, wherein the other wheel support unit is carried on the frame.

6. An improved skateboard as recited in claim 1, in which the frame is made from plastic materials.

7. An improved skateboard as recited in claim 1, wherein the board unit further includes means for centering the pivotal portion of the board member relative to the frame in the first position thereof.

8. An improved skateboard as recited in claim 7, wherein the board member includes at least one elongated downwardly depending rib, and wherein the frame includes at least one elongated upwardly opening slot into which the rib is adapted to extend, whereby the rib and slot together constitute the means for centering the pivotal portion of the board member relative to the frame.

9. An improved skateboard as recited in claim 8, wherein the frame includes two elongated and transversely spaced frame members integrally connected together to form the frame, and wherein the slot is defined by the transverse space between the frame members.

10. An improved skateboard of the type having an elongated board suitable for supporting a rider thereon, wherein the board is rollably supported for movement over a ground surface by front and back sets of support wheels attached thereto, and wherein the improvement relates to an improved means for braking the skateboard, which comprises:

(a) an elongated frame located underneath the board, wherein the front set of support wheels is carried adjacent and is attached to a front end of the frame;

(b) means for pivotably mounting the board adjacent a rear end of the frame for pivotal movement between a first position generally parallel with the frame and a second position disposed at an angle to the frame; and (c) wherein the back set of support wheels is carried by the board for movement relative to the frame such that when the board is in its second position the back set of support wheels engage the frame to brake the board.

11. An improved skateboard as recited in claim 10, wherein the frame includes means for laterally confining the board on the frame when the board is in its first position.

12. An improved skateboard, which comprises:

(a) a board unit, which includes:
  (i) an elongated board member suited for supporting the rider thereon, and
  (ii) an elongated frame underlying the board member for supporting the board member wherein the frame includes two brake shoes fixedly carried thereon;

(b) at least one wheel support unit carried adjacent each end of the board unit for rollably supporting the board unit on a ground surface, wherein each wheel support unit has one or more ground engaging wheels, and wherein the wheel support unit rotatably support the board member and the frame for rotation relative to the wheel support units about a longitudinal axis through the board member; and (c) wherein the wheels of the wheel support units are normally spaced from the brake shoes when the board member is in a first position substantially horizontal to the ground surface, whereby rotation by the rider of the board member about the longitudinal axis causes at least one wheel of one of the wheel support units to engage one of the brake shoes to effect a braking action thereon.

* * * * *